US008065887B2

(12) United States Patent
Ogorevc

(10) Patent No.: US 8,065,887 B2
(45) Date of Patent: Nov. 29, 2011

(54) DISPLAY FOR PUBLIC USE

(76) Inventor: Andraz Ogorevc, Skofljica (SI)

( * ) Notice: Subject to any disclaimer, the term of this patent is extended or adjusted under 35 U.S.C. 154(b) by 1163 days.

(21) Appl. No.: 11/577,871

(22) PCT Filed: May 10, 2005

(86) PCT No.: PCT/SI2005/000012

§ 371 (c)(1),
(2), (4) Date: Apr. 24, 2007

(87) PCT Pub. No.: WO2006/049586

PCT Pub. Date: May 11, 2006

(65) Prior Publication Data

US 2008/0148609 A1 Jun. 26, 2008

(30) Foreign Application Priority Data

Nov. 3, 2004 (SI) ..... 200400298

(51) Int. Cl.
*F25D 23/12* (2006.01)

(52) U.S. Cl. ..... 62/259.2

(58) Field of Classification Search ..... 62/259.2, 62/440, 515

See application file for complete search history.

(56) References Cited

U.S. PATENT DOCUMENTS

| | | | | |
|---|---|---|---|---|
| 6,711,014 | B2 * | 3/2004 | Anzai et al. | 361/679.48 |
| 6,711,912 | B2 * | 3/2004 | Laubacher et al. | 62/259.2 |
| 7,559,209 | B2 * | 7/2009 | Nicolai et al. | 62/259.2 |
| 2003/0084677 | A1 * | 5/2003 | Kagaya et al. | 62/259.2 |

FOREIGN PATENT DOCUMENTS

FR 2756653 * 6/1998

* cited by examiner

*Primary Examiner* — Melvin Jones

(74) *Attorney, Agent, or Firm* — Kevin J. McNeely; McNeely, Hare & War LLP

(57) ABSTRACT

In a basic embodiment of a display for public use including a stand, an internal computer and an internal air conditioning system, the computer (10) is arranged according to the invention inside a housing (7) of the display, an evaporator (1) of an air conditioning device acting as an air delivering member is connected from below to an opening (18) in the floor panel of the housing (7) of the display, with said device being arranged inside the hollow stand (8) of the display, while a compressor (2) of the air conditioning device acting as a member for drawing in air is arranged on the floor panel of the stand (8). Modifications of said solution refer to standless displays providing the equipment either entirely in the housing of the display or entirely outside the housing of the display or partly inside partly outside.

6 Claims, 5 Drawing Sheets

DISPLAY FOR PUBLIC USE

Figure 1:
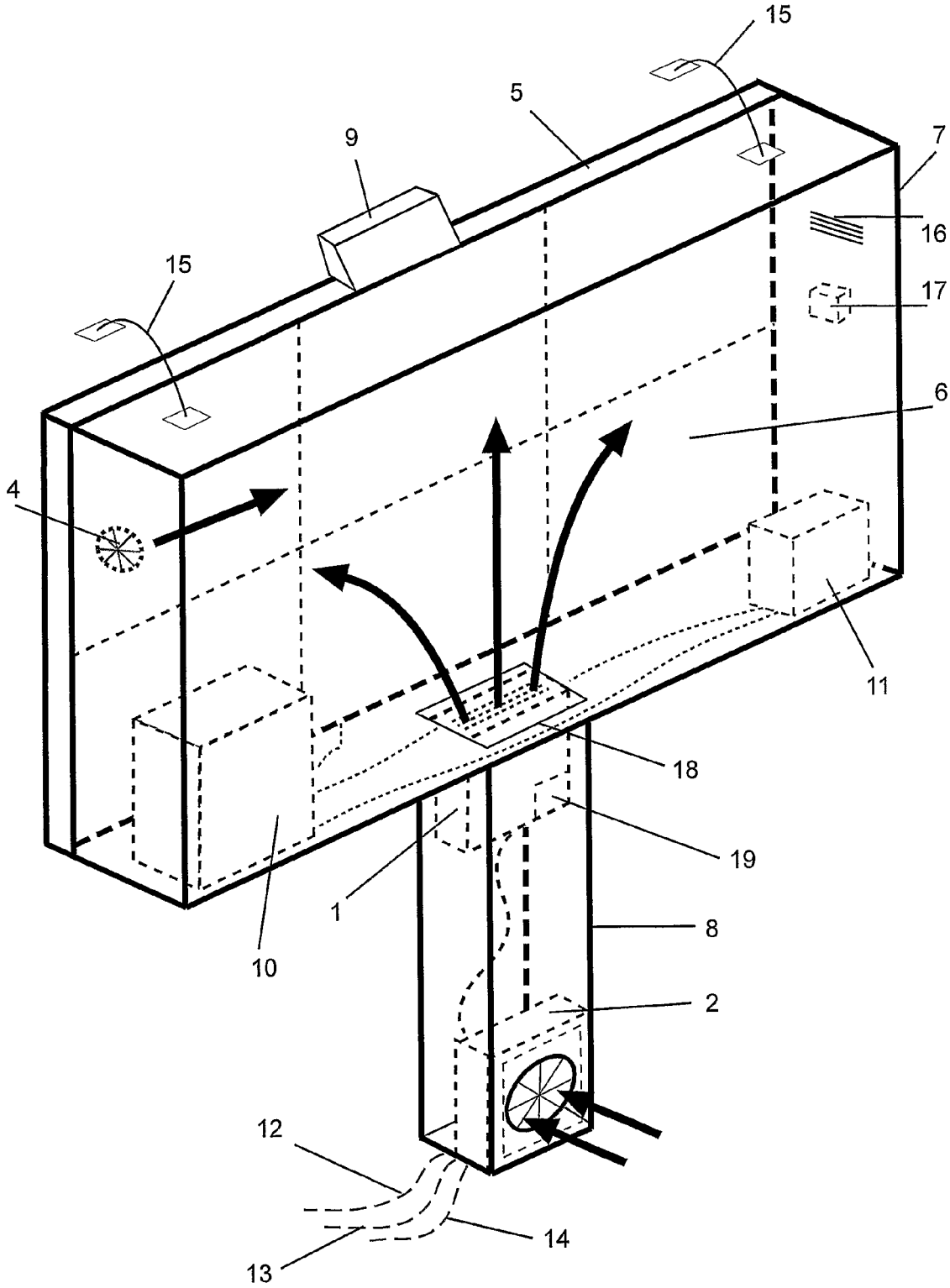

The invention relates to (i) a display for public use including a stand, an internal computer and an internal air conditioning system, (ii) a standless display for public use including an internal computer and an internal member of an air conditioning system, (iii) a standless display for public use including an external computer and an external air conditioning system, (iv) a standless display for public use including an internal computer and an internal air conditioning system, and (v) a standless display for public use including an external computer and an internal member of an air conditioning system.

To (i): In FR 2 756 653 (G. Secerovski), a large panel wide format television display for public use is disclosed. Said device includes a television screen installed in a housing. A television receiver is connected to a computer system mounted in a foot of a structure. Also within said foot of said structure there may be an air conditioning system serving to keep the equipment at a constant temperature. A floor panel of said housing is covered by a grill for diffusing the conditioned air streaming from below, and a perforated plate is arranged over said grill as a carrier for the television receiver. The screen may be 350 cm high, and 300 cm wide.

As the computer resides in the foot next to the air conditioning system it is obvious that the conditioned atmosphere is only provided for the display. With its dimensions, the foot in comparison to the display represents an aesthetic disproportion as well as a material expenditure. Besides, a mere combination of the grill for diffusing the conditioned air and the perforated carrier plate does not result in a homogenous conditioning, whose dryness is a substantial parameter of the interior space of the display.

Hence, the invention proceeds from a problem of obviating the disadvantages of the prior art and, simultaneously, creating a display for public use with said display being of relatively large size measured by meters, and its service invariant as to weather conditions in their wide scope, particularly invariant also to temperature ranges below the freezing point and beyond 40° C., respectively.

With a display for public use including a stand, an internal computer and an internal air conditioning system, said problem is solved, according to the present invention, by that the computer is arranged inside a housing of the display, an evaporator of an air conditioning device acting as an air delivering member, with said device being arranged inside the hollow stand of the display, is connected from below to an opening in the floor panel of the housing of the display, while a compressor of the air conditioning device acting as a member for drawing in air is arranged on the floor panel of the stand. Also the computer thus resides in the atmosphere of conditioned air, and the dimensions of the stand are thus only subordinated to the compressor.

Based on the above solution can be several alternative embodiments, among them standless embodiments, too.

With a standless display for public use, including an internal computer and an internal member of an air conditioning system, the computer is arranged inside a housing of the display, an evaporator of an air conditioning device acting as a member for delivering air is supported inside the housing, preferably by the floor panel thereof, while a compressor of the air conditioning device acting as a member for drawing in air is arranged outside the housing of the display.

With a standless display for public use, including a computer, a feeder for feeding the display with energy for the case of the external feeding being failed, and an air conditioning system, being all arranged externally, a discharge hood or a similar device is installed between an evaporator of an air conditioning device and the housing of the display.

With a standless display for public use including an internal computer and an internal air conditioning system, a compressor of an air conditioning device, a computer, an evaporator of an air conditioning device, and a feeder for feeding the display with energy for the case of the external feeding being failed are all supported by a floor panel of the housing of the display.

And, with a standless display for public use including an internal member of an air conditioning system, a floor panel of the housing of the display supports an evaporator of an air conditioning device and a feeder for feeding the display with energy for the case of the external feeding being failed, while a compressor of an air conditioning device and a computer are positioned outside the housing of the display.

The documents JP 2003 149739 (Iwai Takatoshi), 2004 101094 (Sharp Corp.) and 9 197995 (Matsuda Masayuki et al.), US 2002/009978 (Dukach et al.), DE 201 19 900 U1 (Wincor Nixdorf GmbH & Co. KG), and EP 1 276 092 (Instore TV GmbH) have been considered technological background.

Hereinafter, the present invention is disclosed in more detail on the basis of a primary embodiment and four co-pending alternatives of an inventive display for public use shown in the annexed drawings. In the drawings, FIG. 1 is a primary embodiment of an inventive display for public use, and FIGS. 2 to 5 are four alternatives of the inventive display for public use of FIG. 1, with each embodiment being shown schematically in a three-dimensional view.

In all embodiments, a selected reference number indicates a constructional member and intangibility, respectively, providing the same function.

In a narrower meaning of the word, display is limited to a housing 7, whose front wall is made of a glass panel 5. Behind the glass panel 5, at least one video apparatus 6 is arranged inside the housing 7 with said video apparatus per se being an independent construction. In the proposed five shown embodiments, a set of six video apparatuses 6 is foreseen in each of them.

In a free inside space of the housing 7 of the display behind the video apparatuses 6, there resides a functional equipment of the display or a part thereof.

In all shown embodiments, an air conditioning device is composed of an evaporator 1, a compressor 2, a control unit 19 and interconnecting cables and pipelines, through which a working fluid flows. With all embodiments, the control unit 19 is integrated in the evaporator 1 that in the air conditioning device is an air-delivering member. Air conditioning means air heating/cooling, elimination of static electricity as well as controlling of the dampness of air in the housing 7.

To the equipment of the housing 7 of the display there belong an inner equipment: a ventilator 4 for mixing air in the housing 7, a sensor 17 for detecting the temperature and dampness of air in the housing 7 as well as gills 16 for venting the housing 7; and an outer equipment: lamps 15 and a loudspeaker 9, provided the display for public use is an audio installation.

In the embodiment of FIG. 1, a first end part of a floor panel of the housing 7 supports a computer 10, a second one supports a feeder 11 for feeding the display with energy for the case of the external feeding being failed. There between resides, over a stand 8, an opening 18 in the floor panel of the housing 7 of the display.

Figure 2:
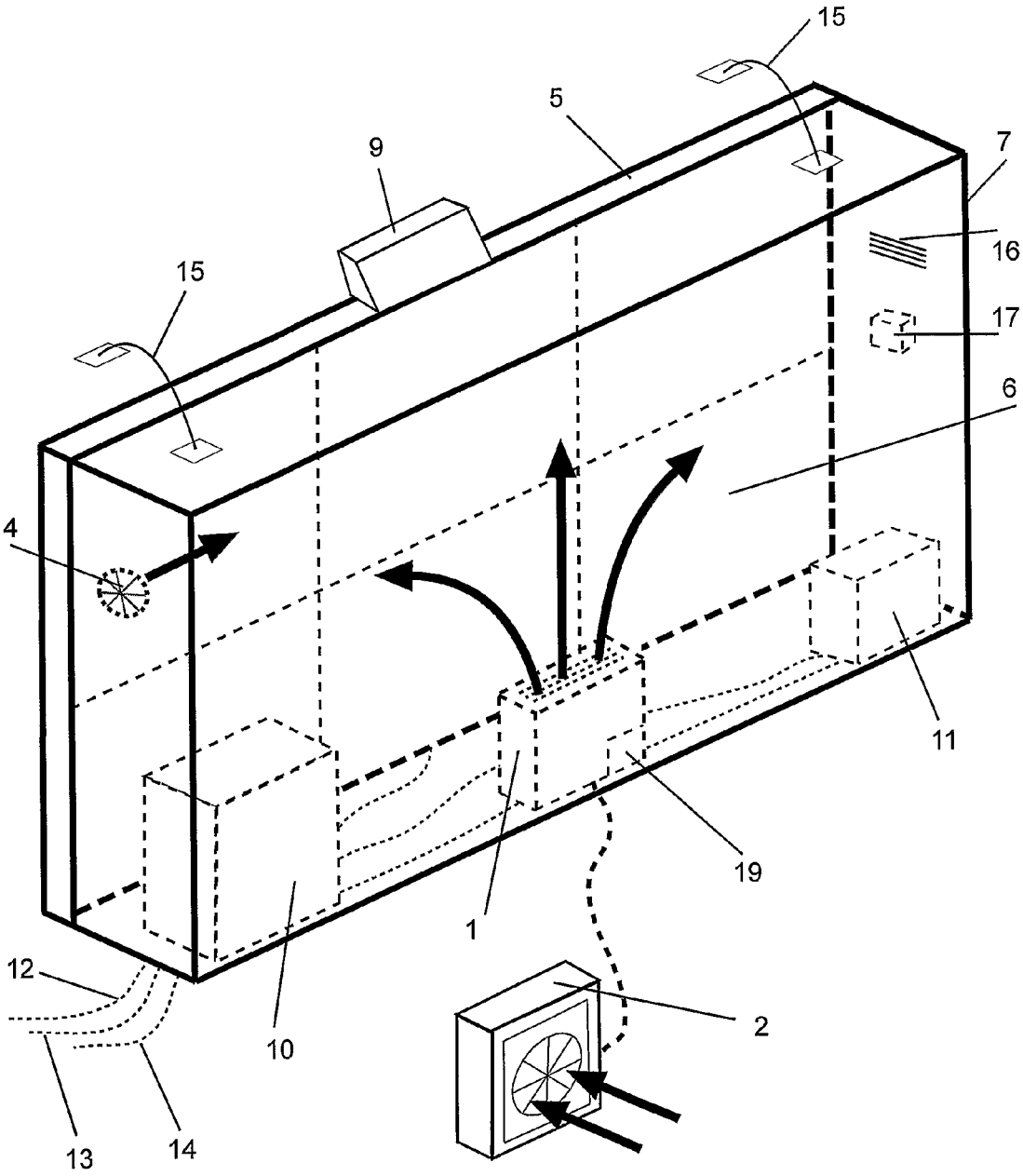

In the embodiment of FIG. 2, the computer 10 and the feeder 11 are positioned as embodied in FIG. 1, the evaporator 1 is positioned there between, whereas the compressor 2 is positioned outside the housing 7.

Figure 3:
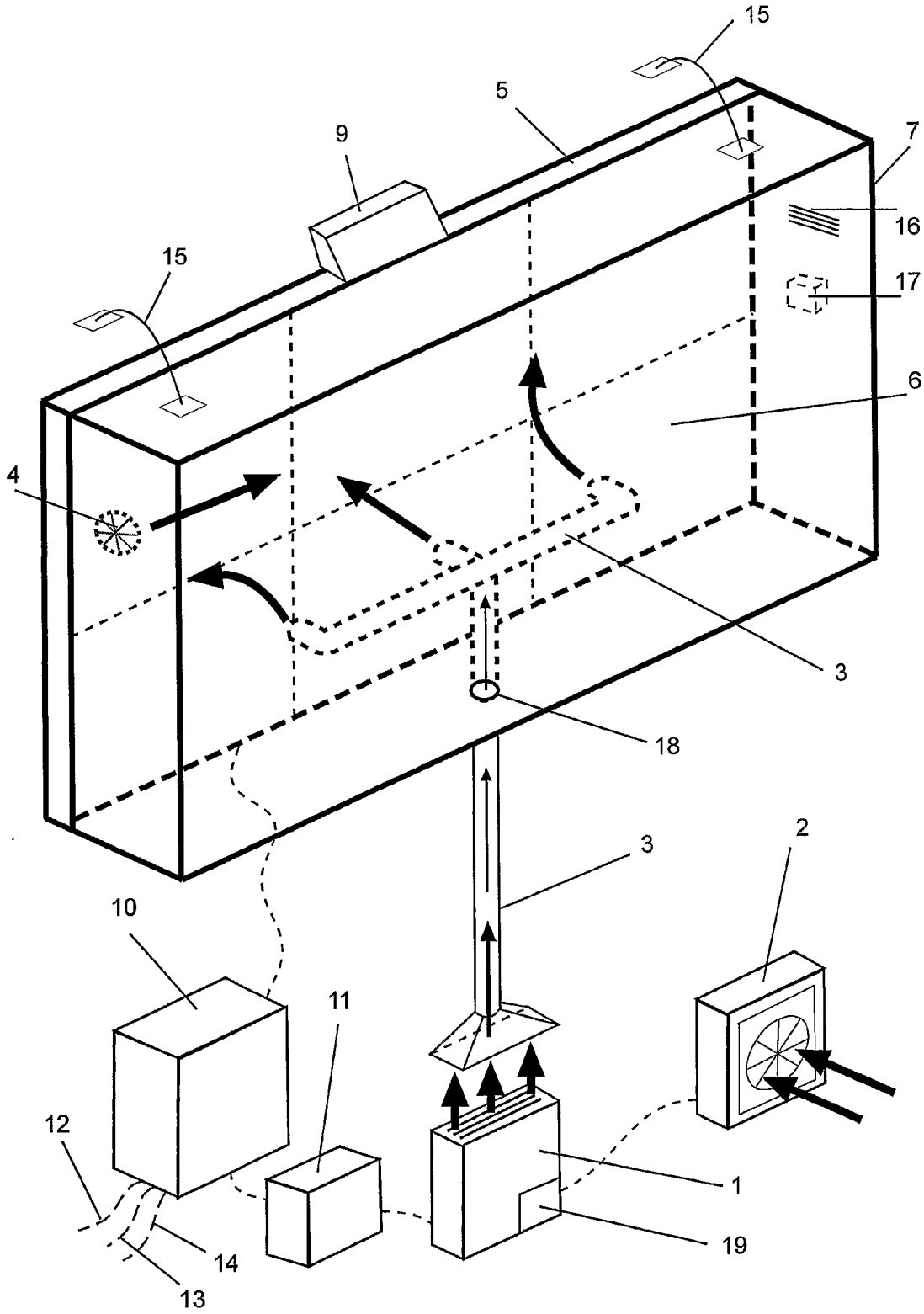

In the embodiment of FIG. 3, the computer 10, the feeder 11, the evaporator 1 including the control unit 19, and the compressor 2 are positioned outside the housing 7. In this embodiment, a discharge hood 3 is installed over the evaporator 1, said hood being connected to the housing 7, more precisely to its floor panel, by a pipe. In this specific case, a manifold is connected to said pipe inside the housing 7.

Figure 4:
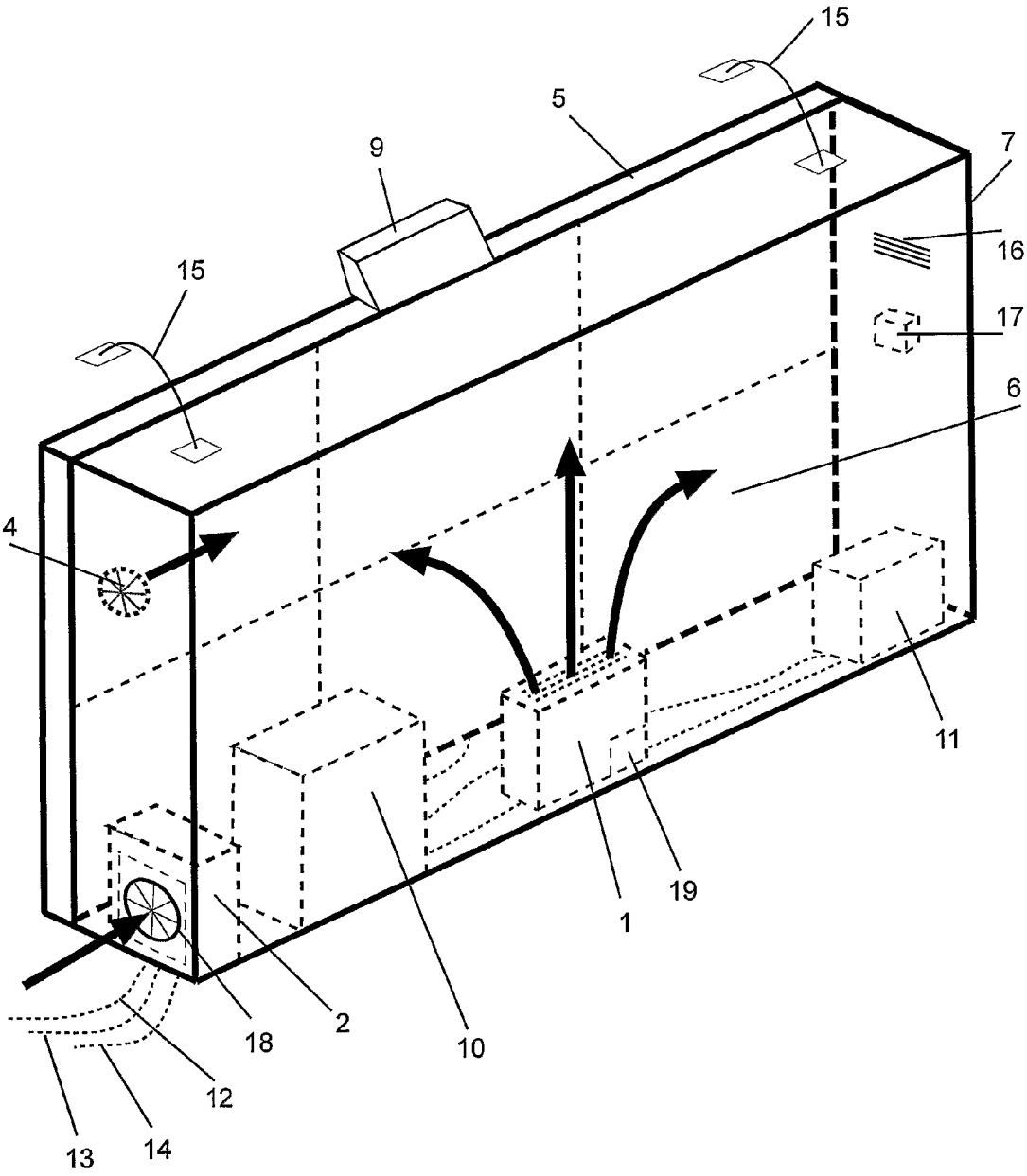

In the embodiment of FIG. 4, entire functional equipment is housed in the housing 7 of the display. Specifically, there are positioned on the floor panel of the housing 7, in series, the compressor 2, the computer 10, the evaporator 1 and the feeder 11.

Figure 5:
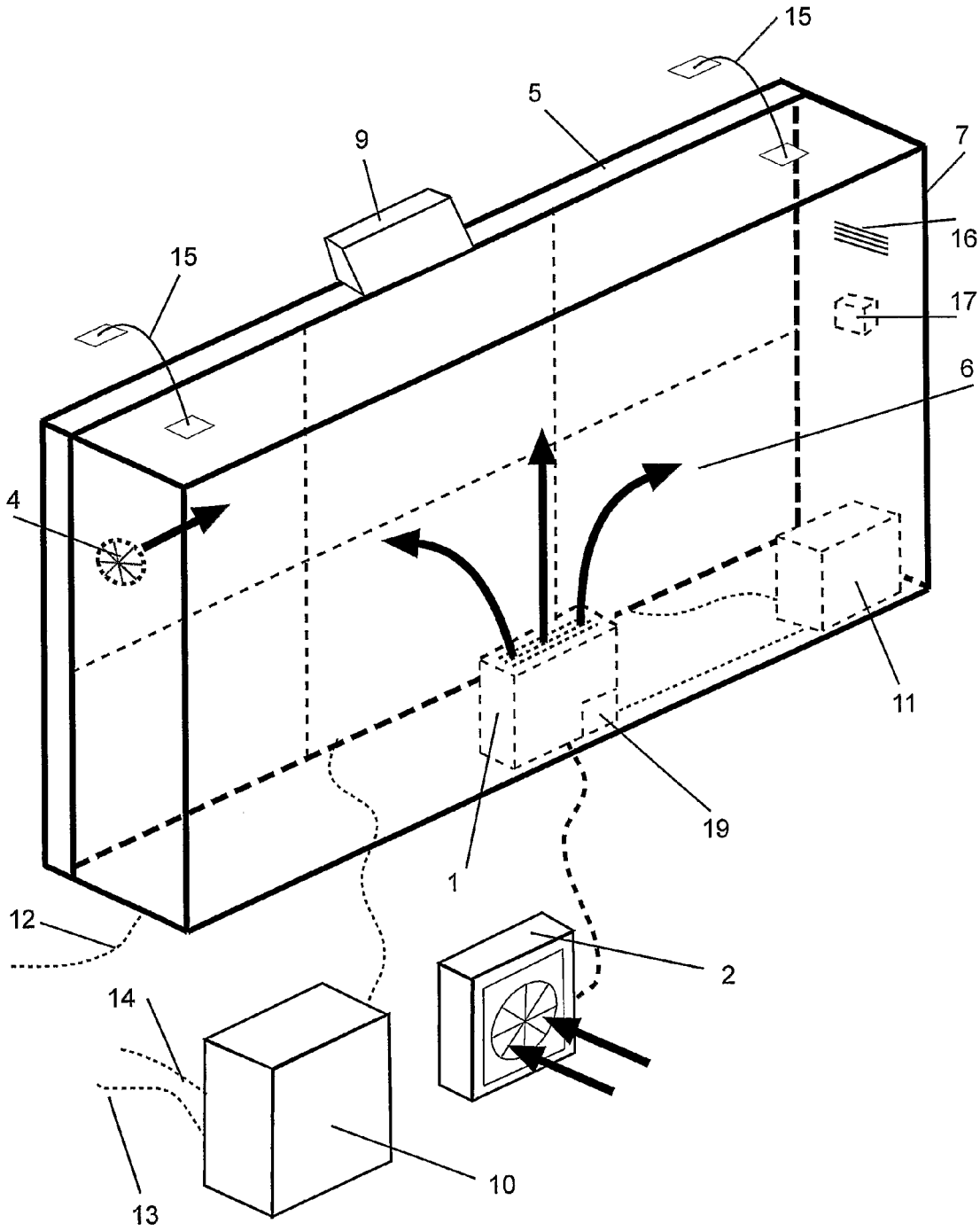

And, in the embodiment of FIG. 5, the floor panel of the housing 7 supports, preferably in the middle of said panel, the evaporator 1, and with one of two end parts of said panel, there is positioned the feeder 11. The computer 10 and the compressor 2 reside outside the housing 7.

It is to note that said hood 3 and said manifold shown in FIG. 3 can conveniently be applied with all suggested embodiments in connection with the evaporator 1.

Outer conduits, such as an electric connection 12, an Internet connection 13 and a television cable 14 are connected to the installation.

The invention claimed is:

1. Display for public use, comprising:

a hollow stand;

a housing that includes a floor panel;

a computer arranged inside the housing; and an air conditioning device arranged inside the hollow stand;

wherein an evaporator of the air conditioning device is connected to an opening in the floor panel of the housing, while a compressor of the air conditioning device is arranged on the floor panel of the stand.

2. Display of claim 1, wherein the evaporator of the air conditioning device is supported inside the housing, while the compressor of the air conditioning device is arranged outside the housing.

3. Display of claim 1, wherein a discharge hood is installed between the evaporator of the air conditioning device and the housing.

4. Display of claim 1, wherein the floor panel of the housing supports the evaporator and a feeder for feeding the display with energy during a failure of an external power feed, while the compressor of the air conditioning device and the computer are positioned outside the housing.

5. A display for public use, comprising:

a hollow stand;

a housing that includes a floor panel;

a computer arranged inside the housing; and an air conditioning device arranged inside the hollow stand;

wherein an evaporator of the air conditioning device is connected to an opening in the floor panel of the housing and supported by the housing, and a compressor of the air conditioning device is arranged outside of the housing on the floor panel of the stand.

6. A display for public use, comprising:

a hollow stand;

a housing;

a computer arranged outside the housing;

a feeder for feeding in the event of a failure of an external power feed;

an air conditioning device that includes a compressor and an evaporator;

wherein the evaporator of the air conditioning device and the feeder are supported by a floor panel of the housing, and the compressor of the air conditioning device is arranged outside of the housing.

* * * * *